United States Patent [19]

Terasawa et al.

[11] Patent Number: 4,967,204

[45] Date of Patent: Oct. 30, 1990

[54] METHOD FOR ENSURING STABLE OPERATION OF AN INK JET RECORDING APPARATUS

[75] Inventors: Koji Terasawa, Mitaka; Hideaki Okamoto; Hideki Yamaguchi, both of Yokohama, all of Japan

[73] Assignee: Canon Kabushiki Kaisha, Tokyo, Japan

[21] Appl. No.: 323,161

[22] Filed: Mar. 15, 1989

Related U.S. Application Data

[63] Continuation of Ser. No. 246,964, Sep. 21, 1988, abandoned, which is a continuation of Ser. No. 180,674, Apr. 7, 1988, abandoned, which is a continuation of Ser. No. 911,766, Sep. 26, 1986, abandoned.

[30] Foreign Application Priority Data

Oct. 1, 1985 [JP] Japan ..... 60-218252
Oct. 1, 1985 [JP] Japan ..... 60-218253

[51] Int. Cl.[5] ..... B41J 2/165
[52] U.S. Cl. ..... 346/1.1; 346/140 R
[58] Field of Search ..... 346/1.1, 140, 75

[56] References Cited

U.S. PATENT DOCUMENTS 3,925,789 12/1975 Kashio ..... 346/75
3,945,021 3/1976 Kraus ..... 346/140 X
4,176,363 11/1979 Kasahara ..... 346/140 R
4,362,572 12/1982 Wallace ..... 346/140 X
4,367,479 1/1983 Bower ..... 346/140
4,577,203 3/1986 Kawamura ..... 346/140
4,631,556 12/1986 Watanabe ..... 346/140
4,692,777 9/1987 Hasumi ..... 346/140

FOREIGN PATENT DOCUMENTS 0094220 11/1983 European Pat. Off. .
2827673 1/1979 Fed. Rep. of Germany .
3326717 2/1984 Fed. Rep. of Germany .

*Primary Examiner*—Joseph W. Hartary
*Attorney, Agent, or Firm*—Fitzpatrick, Cella, Harper & Scinto

[57] ABSTRACT

An operation method on an ink jet recording apparatus, comprises the steps of: moving a recording head to a position at which the recording head faces to a cap, causing the recording head to discharge ink from an ink discharge port thereof into the cap after each lapse of a predetermined time period or each lapse of a printing operation period for a predetermined numbers of lines; and idle-discharging the ink collected in the cap when the removing operation of a recording medium is performed succeedingly to the discharge, or when the period longer than said printing operation period has been lapsed while the recording head stays at the position.

30 Claims, 4 Drawing Sheets

METHOD FOR ENSURING STABLE OPERATION OF AN INK JET RECORDING APPARATUS

This application is a continuation of application Ser. No. 246,964 filed Sept. 21, 1988, now abandoned, which is a continuation of application Ser. No. 180,674 filed Apr. 7, 1988, now abandoned, which is a continuation of application Ser. No. 911,766 filed Sept. 26, 1986 now abandoned.

BACKGROUND OF THE INVENTION

1. Field of the Invention

The present invention relates to an ink jet recording apparatus and an operating method thereof and, more particularly, to an ink jet recorder and an operating method of an ink jet recording apparatus for preventing poor ink discharge from an ink discharge port of a recording head.

2. Related Background Art

An ink jet recording apparatus supplies ink in a recording head, and a drive element or elements (i.e., an electrical-thermal energy converter, e.g., a heat generating element or an electric-mechanical energy converter, e.g., a piezoelectric element) corresponding to one or a plurality of ink discharge ports, formed in the front surface of the recording head are driven in accordance with a data signal, thereby discharging ink from the ink discharge port as ink droplets toward a recording medium (recording paper) to record an image.

In the ink jet recording apparatus of this type, a capping operation is performed for capping the ink discharge ports with a cap while not printing and a recovery operation for restoring the discharge function, e.g., a predetermined idle discharge, for discharging ink away from a printing area is sometimes carried out. This prevents the ink discharge ports from clogging caused by an increase in viscosity of ink due to evaporation of an ink solvent or ingestion of dust or mixture of bubbles and stabilizes printing quality.

Conventionally, an operator visually judges the printing quality and carries out the recovery operation in accordance with the judgment. However, it is difficult to judge whether or not the recovery operation is absolutely necessary.

In addition, it is difficult to always maintain a stable, objectively good ink discharge condition if the recovery operation is performed only when the operator subjectively judges it necessary.

If no print command is supplied for a predetermined period of time, the ink discharge portion is dried, and its initial discharge characteristic is degraded, resulting in unstable ink discharge. This problem is particularly noticeable when ink having a high dye concentration is used.

U.S. Pat. No. 3,925,789 discloses a continuous type ink jet recording apparatus which performs ink ejection from a nozzle prior to the next printing operation when the interval between ink injection commands becomes a predetermined interval after the apparatus is powered on and is in the print waiting state.

However, if such ejection is repeated excessively, the amount of waste ink is undesirably increased. In the case that the recording head has a plurality of ink discharge ports, some of the ink discharge ports may not have been used for a long period of time, and the portion of the discharge ports may be dried, resulting in unstable ink discharge.

Further, even if ink is discharged from the ink discharge port into the cap, the ink collected in the cap by the discharge over-flow and the overflow ink may contaminate the ink jet recording apparatus.

SUMMARY OF THE INVENTION

It is an object of the present invention to provide an ink jet recording apparatus which can stably maintain a good ink discharge condition.

It is another object of the present invention to provide an operating method of an ink jet recording apparatus which can perform a recovery operation without contaminating the ink jet recording apparatus.

It is still another object of the present invention to provide an operating method of an ink jet recording apparatus which will not waste ink.

It is still another object of the present invention to provide an operating method of an ink jet recording apparatus which has a simple arrangement.

It is still another object of the present invention to provide an operating method of an ink jet recording apparatus, comprising the steps of moving a recording head to position at which the recording head faces to a cap, to cause the recording head to discharge ink from an ink discharge port thereof into the cap after each lapse of a predetermined time period or each lapse of a printing operation period for a predetermined numbers of lines; and idle-discharging the ink collected in the cap when the removing operation of a recording medium is performed succeedingly to the discharge, or when the period longer than the printing operation period has been lapsed while the recording head stays at the position.

It is still another object of the present invention to provide an operating method of an ink jet recording apparatus, comprising the steps:

causing a recording head to discharge ink from a discharge port thereof into a cap after each lapse of a predetermined time period during non-printing operation;

sucking ink collected in the cap when the causing step has been performed a predetermined times; and putting off the power of the recording apparatus when the non-printing operation continues for period longer than said predetermined period succeedingly to the discharge step.

DESCRIPTION OF THE PREFERRED EMBODIMENTS

The present invention will be described hereinafter in detail with reference to the accompanying drawings.

(Embodiment 1)

Figure 1:
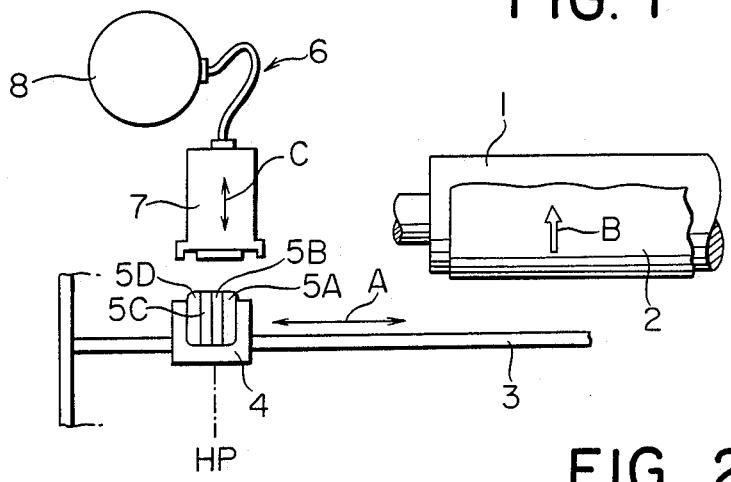
FIG. 1 is a plan view of the main part of an embodiment of an ink jet recording apparatus suitable for carrying out a method of the present invention.

FIG. 1 is a plan view of the main part of an embodiment of an ink jet recording apparatus suitable for carrying out the method of the present invention.

Referring to FIG. 1, a guide shaft 3 is arranged in front of a recording medium 2, e.g., a paper sheet or a plastic sheet, backed up by a platen 1, and a plurality (four in this embodiment) of recording heads 5A, 5B, 5C, and 5D are mounted on a carriage 4 which is moved in a direction indicated by arrow A along the guide shaft 3.

Figure 2:
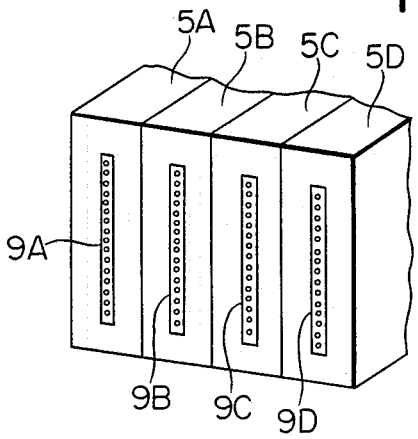
FIG. 2 is a perspective view of a recording head of the apparatus shown in FIG. 1.

FIG. 2 is a perspective view of the recording heads 5A to 5D of the ink jet recording apparatus shown in FIG. 1. A plurality of ink discharge ports 9A to 9D for discharging ink are respectively formed in the front surfaces of the recording heads 5A to 5D, as shown in FIG. 2. Ink is discharged from the respective ink discharge ports in accordance with a data signal, thus recording an image on the recording medium 2.

The recording heads 5A to 5D are provided for effecting a recording operation using color inks (cyan, magenta, yellow, and black) or using dark to light inks having the same color phase.

The recording medium 2 is fed in a direction indicated by arrow B by a paper feed roller (in FIG. 1, the roller-like platen 1 also serves as the paper feed roller).

A pump suction type ink recovery means 6 is arranged at a home position HP of the carriage 4.

The ink recovery means 6 comprises a cap 7 which is moved forward and backward in the direction of arrow C with respect to the recording heads 5A to 5D and closes the ink discharge ports upon its forward movement, and a negative pressure source 8, e.g., a suction pump, for evacuating the interior of the cap 7 to a negative pressure.

The ink jet recording apparatus with the above arrangement moves the recording heads 5A to 5D together with the carriage 4 to a position facing the cap 7 of the ink recovery means 6 (in FIG. 1, the home position HP) after a predetermined time T1 for printing operation, or after a time period for a printing operation for a predetermined number of lines, that is, the time period in which the scanning movement has been performed by a predetermined number of times, has passed. The ink jet recording apparatus then moves the cap 7 forward to perform a capping operation if necessary. Thereafter, ink is discharged from the ink discharge ports into the cap 7.

The suction pump 8 is driven when predetermined operation has been performed, e.g., a recording medium exhaust operation, or after a given preset time T2 longer than the time T1 has passed while the recording head stays at position at which ink is discharged into the cap, to perform idle suction of the ink in the cap 7, thereby exhausting the ink therefrom. Note that the predetermined operation can be a paper feed operation of a predetermined length, a printing operation for a predetermined number of lines, or a predetermined number of times of discharge operations in addition to the recording medium exhaust operation.

In this embodiment, "idle suction" means that suction is performed in the state wherein the cap is separated from the recording heads and no capping is made or in the state wherein even if the capping is made, the cap communicates with ambient air so as not to discharge ink by suction from the ink discharge ports.

Figure 3:
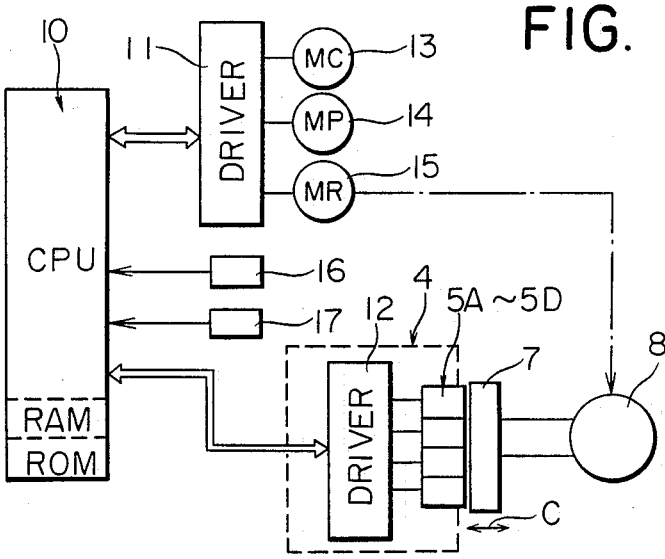
FIG. 3 is a block diagram of a control system suitable for carrying out the method of the present invention.

FIG. 3 is a block diagram of a control system suitable for carrying out the method of the present invention.

Referring to FIG. 3, a CPU 10 (control circuit) of the ink jet recording apparatus is connected to a first driver 11 and a second driver 12 on the carriage 4. A carriage motor 13, a paper feed motor 14, a motor 15 for driving the ink recovery means 6, and the like are driven by the CPU 10 through the first driver 11. The recording heads 5A to 5D are driven by the CPU 10 through the second driver 12 to discharge ink from the ink discharge ports 9A to 9D.

The motor 15 for driving the ink recovery means 6 is used both for moving the cap 7 forward and backward and driving the suction pump 8. Alternatively, they can be driven by separate motors.

Note that a control program for the control system shown in FIG. 3 is stored in a ROM incorporated in the CPU 10.

The CPU 10 is connected to an idle-discharge timing sensor 16 for detecting the lapse of the predetermined time for printing operation, the time period for the printing operation time for the predetermined number of lines, and a suction timing sensor 17 for detecting the predetermined operation, e.g., the recording medium exhaust operation or the lapse of the predetermined time T2 longer than the time T1 while the recording head stops at position at which the recording head discharges ink into the cap. The operating method of the present invention is carried out in accordance with detection signals from these sensors 16 and 17.

Figure 4:
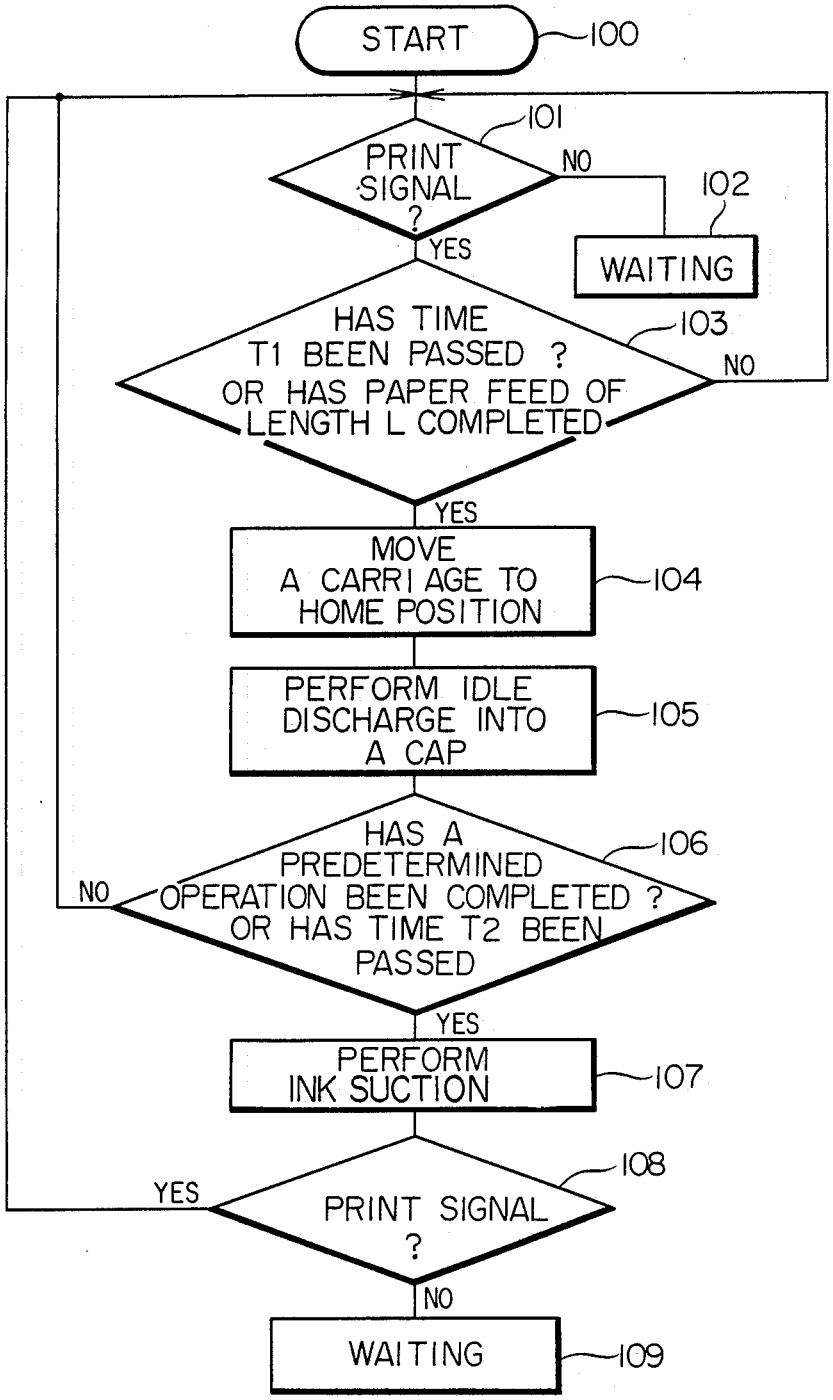
FIG. 4 is a flow chart for explaining the operation procedures of the first embodiment of the present invention.

FIG. 4 is a flow chart for explaining the operation procedures of a first embodiment of the present invention.

Referring to FIG. 4, when the power source of the ink jet recording apparatus is turned on, the operation is initiated in step 100. In step 101, the presence/absence of a print signal is checked. If NO in step 101, the flow advances to step 102, and the apparatus is set in the print waiting state.

If YES in step 101 the flow advances to step 103, and it is checked if the predetermined time T1 for printing operation has passed (by a timer) or if the given length L has been fed the time period for the printing operation for a predetermined number of lines has passed. If NO in step 103, the flow returns to step 101. However, if YES in step 103, the flow advances to step 104, and the carriage 4 is moved to a position (normally, the home position HP) facing the ink recovery means 6, so that the recording heads 5A to 5D are capped as needed. In step 105, ink is idle-discharged from the ink discharge ports 9A to 9D into the cap 7.

It is then checked in step 106 if the predetermined operation, e.g., the exhaust operation of the recording medium 2, has been performed, or if the predetermined time T2 longer than the time T1 has passed while the recording head stays at the position at which the recording head discharges ink into the cap.

If NO in step 106, the flow returns to the step 101, and the above operation is repeated. However, if YES in step 106, the flow advances to step 107, and idle-suction of the ink in the cap 7 is performed by driving the suction pump 8.

The presence/absence of the print signal is checked in step 108. If YES in step 108, the flow returns to step 101, and the above operation is repeated. If NO in step 108, the flow advances to step 109, and the apparatus is set in the print waiting state.

According to the operating method of the ink jet recording apparatus described above, in a multihead recording apparatus (mounting a plurality of recording heads), even if a specific recording head or specific ink discharge ports of the respective recording heads are not used (driven) over a predetermined period of time during the recording (printing) operation, since the discharge of ink into the cap is performed after the lapse of predetermined time T1, for printing operation length L, or the lapse of the printing operation for the predetermined number of lines, drying of ink or an increase in viscosity of the ink at the ink discharge ports 9A to 9D can be prevented, and stable ink discharge can always be obtained, thus maintaining good printing quality.

Since the discharge of the ink into the cap 7 is subjected to automatic idle suction after each predetermined operation, e.g., the recording medium exhaust operation, or lapse of the predetermined time T2, longer than the predetermined time T1 while the recording head stays at position at which ink in discharged into the cap, the amount of ink in the cap 7 can be kept constant or lower, thus preventing the apparatus from being contaminated due to ink overflow.

Since the discharge of the ink into the cap or idle suction in the cap 7 is performed by using the known ink recovery means 6, a special means therefor is not required, and the control circuit need only be changed, resulting in a very simple arrangement.

Note that in the above embodiment, the four recording heads 5A to 5D are provided. However, the present invention can be carried out similarly regardless of the number of recording heads (including a single recording head).

(EMBODIMENT 2)

Figure 5:
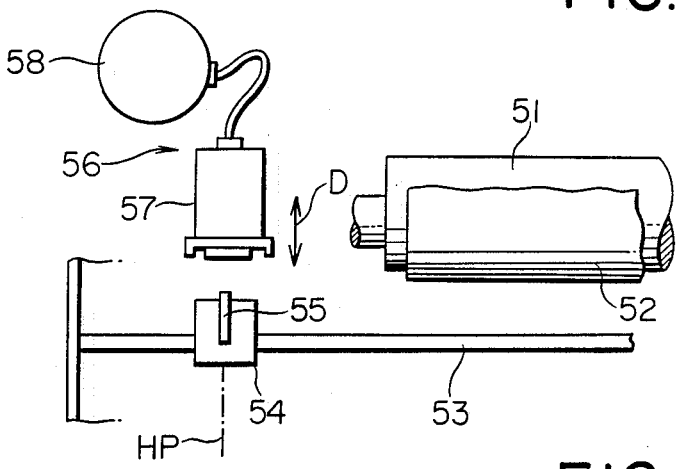
FIG. 5 is a plan view of the main part of another embodiment of an ink jet recording apparatus suitable for carrying out the method of the present invention.
Figure 6:
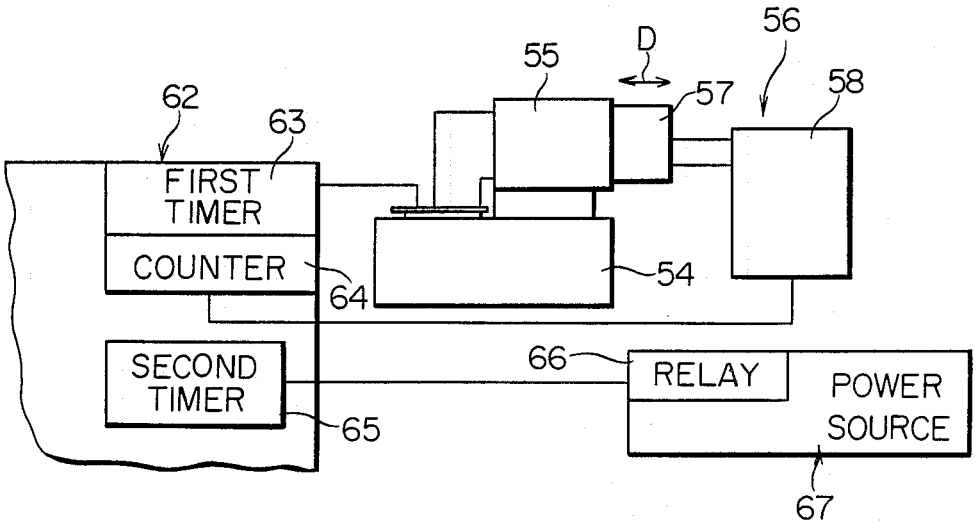
FIG. 6 is a block diagram of another control system suitable for carrying out the method of the present invention.

FIG. 5 is a plan view of another embodiment of an ink jet recording apparatus suitable for carrying out the method of the present invention. FIG. 6 is a block diagram of another embodiment of a control system suitable for carrying out the method of the present invention.

Referring to FIG. 5, a guide shaft 53 is arranged in front of a recording medium 52, e.g., a paper sheet or a plastic sheet, backed up by a platen 51, and a recording head 55 is mounted on a carriage 54 which is moved along the guide shaft 53.

One or a plurality of ink discharge ports are formed in the front surface of the recording head 55. Ink is discharged from the respective ink discharge ports in accordance with a data signal, thus recording an image on the sheet 52.

A pump suction type ink recovery means 56 is arranged at a home position HP of the carriage 54. The ink recovery means 56 comprises a cap 57 which is moved forward and backward in the direction of arrow D with respect to the recording head 55 and closes the ink discharge holes upon its forward movement, and a negative pressure source 58, e.g., a suction pump, for evacuating the interior of the cap 57 to a negative pressure.

Figure 7:
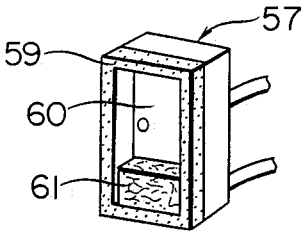
FIG. 7 is a perspective view of a cap of the apparatus shown in FIG. 5.

FIG. 7 is a perspective of the cap 57. The peripheral portion of the cap 57, which is pressed against the front surface of the recording head 55 in which the ink discharge holes are formed, is formed of a rubber-like elastic member 59. The cap 57 houses an ink absorbing member 61 in its inner space 60.

In the state wherein the power source of the ink jet recording apparatus is turned on, if a print command has not been supplied for a predetermined period of time, ink is discharged into the cap 57, i.e., its inner space 60, from the ink discharge port. When the number of times of the discharges into the cap reaches a predetermined value (e.g., 30 times), the ink collected in the cap 57 is subjected to idle suction by the pump 58, thereby controlling the amount of ink in the cap 57. If the print command has not been generated for a further long period of time, the power source of the ink jet recording apparatus is turned off.

Referring to FIG. 6, a control circuit (e.g., a control card constituting a CPU) 62 of the ink jet recording apparatus comprises a first timer 63 for detecting whether or not the lapse time from detection of the print command has reached a preset value (time out), a counter 64 for detecting the number of times of the discharge of ink into the cap after idle suction, and a second timer 65 for detecting that the print command has not been generated for a given period of time longer than the preset time of the first timer 63.

Each time the first timer 63 shown in FIG. 6 is timed out, the recording head 55 is driven to discharge ink into the cap 57. When the number of times of the discharge reaches a preset value, the ink in the cap 57 is exhausted by idle suction using the suction pump 58, thereby preventing ink overflow.

When the preset time longer than that of the first timer 63 has passed after the print command is detected, a relay 66 is operated by the second timer 65 regardless of the discharge of ink into the cap and suction of ink, thereby turning off a power source circuit 67.

Figure 8:
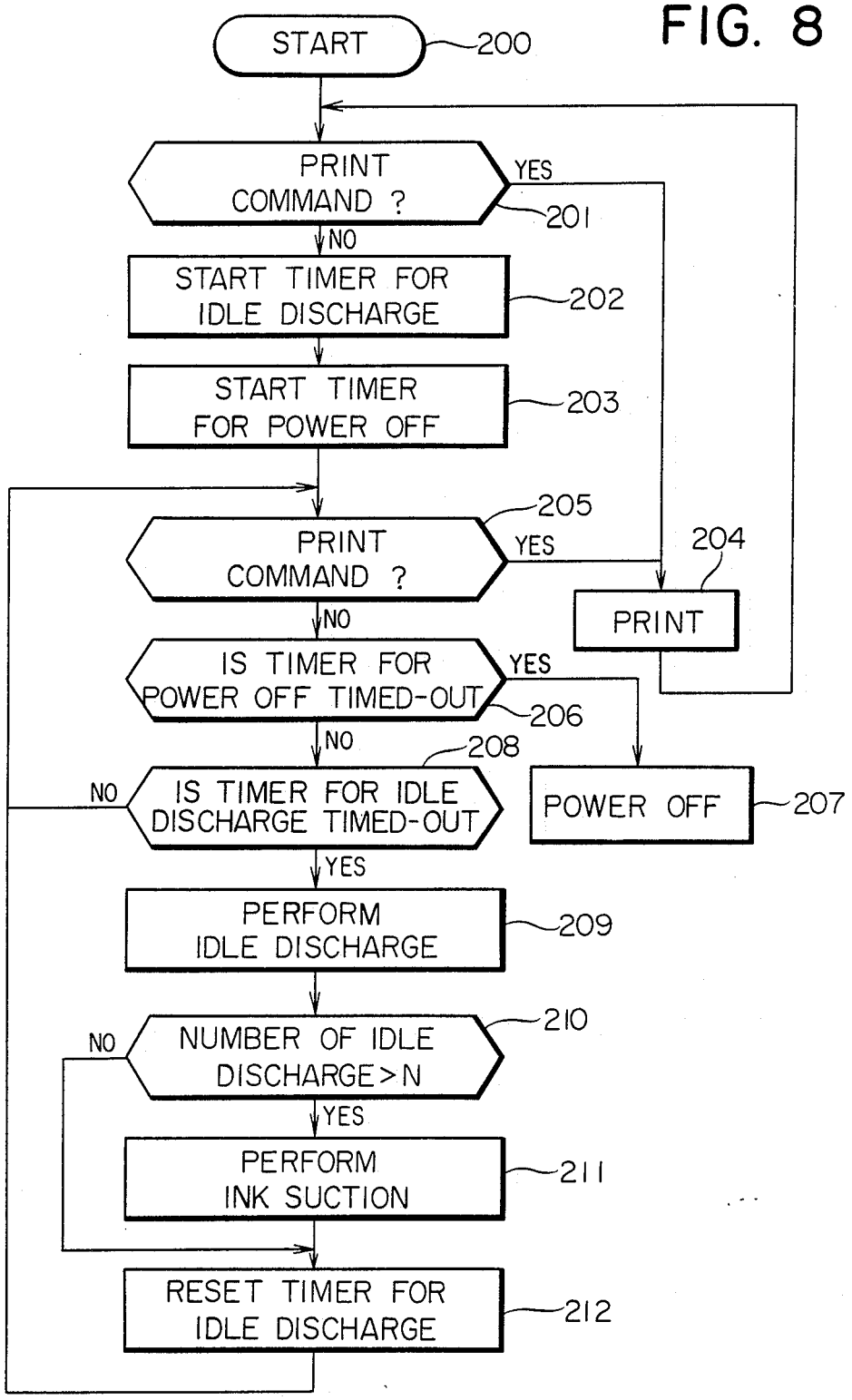
FIG. 8 is a flow chart for explaining the operation procedures of the second embodiment of the present invention.

FIG. 8 is a flow chart for explaining the operation procedures of the second embodiment of the present invention.

Referring to FIG. 8, when the recording apparatus is enabled by turning on the power source in step 200, the presence/absence of the print command is checked in step 201. If NO in step 201, the first timer 63 for the discharge of ink into the cap is driven in step 202 and, at the same time, the second timer 65 for turning off the power source is driven in step 203.

If YES in step 201, the flow advances to step 204, and the print operation is performed. The print operation is repeated for each supply of the print command, and the recording operation is performed by repeating this subroutine.

After the timers 63 and 65 are driven, the presence/absence of the print command is checked for each clock interval, in step 205. If YES in step 205, the flow advances to step 204. However, if NO in step 205, it is checked in step 206 if the second timer 65 for power off is timed out. If YES in step 206, the power source is turned off while the recording head is capped.

If NO in step 206, the flow advances to step 208, and it is checked if the first timer 63 for the discharge into the cap is timed out.

If NO in step 208, the flow returns to step 205, the presence/absence of the print command is detected, and the predetermined operation is repeated.

However, if YES in step 208, ink is discharged into the cap 57 from the ink discharge holes, and it is checked in step 210 if the number of times of idle discharge has reached a preset number N.

If YES in step 210, the suction pump 58 is driven to discharge ink in the cap 57 by suction, in step 211.

However, if NO in step 210, the flow advances to step 212, the first timer 63 for idle discharge is reset, the flow returns to step 205, and the above operation is repeated.

According to the operating method of the ink jet recording apparatus described above, if ink is used which has a high dye density and is quickly dried or increases its viscosity, the discharge of ink into the cap is automatically performed after a predetermined period of time has passed from the last detection of the print command. Therefore, degradation of initial discharge characteristic due to unstable initial discharge can be reliably prevented, and a stable printing quality can be maintained.

Since the discharged ink is appropriately drawn by suction and exhausted in accordance with the number of times of the discharge of ink into the cap, ink overflow from the cap 57 can be prevented, thus preventing the ink jet recording apparatus from being contaminated with ink.

When the print command has not been generated over a long period of time (preset time), the power source is automatically turned off. Therefore, ink will not be wasted due to excessive idle discharge of ink.

We claim:

1. A method of operating an ink jet recording apparatus, said apparatus including a recording head for discharging ink through an ink discharge port therein onto a recording medium, a cap for capping the ink discharge port, and sucking means for sucking the ink in the cap, said method comprising the steps of:

determining if a predetermined time period has elapsed during a non-printing operation;

causing the recording head to discharge ink through the discharge port into the cap when the predetermined time period has elapsed during a non-printing operation;

determining if the causing step has been performed a predetermined number of times;

sucking ink collected in the cap when the causing step has been performed a predetermined number of times, by means of the sucking means;

determining if the non-printing operation continues for a second period longer than the predetermined time period; and removing power from the recording apparatus when the non-printing operating continues for a second period longer than the predetermined time period.

2. The method of claim 1, further including generating thermal energy used for discharging ink by a heat generating element in the recording head.

3. The method of claim 1, further including generating mechanical energy used for discharging ink by a piezoelectric element in the recording head.

4. A method of operating an ink jet recording apparatus, said apparatus including a recording head for discharging ink through an ink discharge port therein onto a recording medium, a cap for capping the ink discharge port, sucking means for sucking ink in the cap, and feeding means for feeding the recording medium, said method comprising the steps of:

determining if a predetermined time period has elapsed during a recording operating;

moving the recording head to a position at which the recording head faces the cap so as to cause the recording head to discharge ink through the ink discharge port into the cap when the predetermined time period has elapsed during a recording operation;

determining if the recording medium has been fed out from the feeding means; and sucking ink collected in the cap when the recording medium has been fed out from the feeding means, by means of the sucking means.

5. The method of claim 4, further including capping a peripheral portion of the ink discharge port of the recording head with the cap before the discharge of ink into the cap and after said moving of the recording head.

6. The method of claim 4, further including generating thermal energy used for discharging ink by a heat generating element in the recording head.

7. The method of claim 4, further including generating mechanical energy used for discharging ink by a piezoelectric element in the recording head.

8. A method of operating an ink jet recording apparatus, said apparatus including a recording head for discharging ink through an ink discharge port therein onto a recording medium, a cap for capping the ink discharge port, and sucking means for sucking the ink in the cap, said method comprising the steps of:

determining if a predetermined time period has elapsed during a recording operation;

moving the recording head to a position at which the recording head faces the cap so as to cause the recording head to discharge ink through the ink discharge port into the cap when the predetermined time period has elapsed during a recording operation;

determining if the recording head is facing the cap for a time period longer than the predetermined time period; and sucking ink collected in the cap when the recording head is facing the cap for a time period longer than the predetermined time period, by means of the sucking means.

9. The method for claim 8, further including capping a peripheral portion of the ink discharge port of the recording head with the cap before the discharge of ink into the cap and after said moving of the recording head.

10. The method of claim 8, further including generating thermal energy used for discharging ink by a heat generating element in the recording head.

11. The method of claim 8, further including generating mechanical energy used for discharging ink by a piezoelectric element in the recording head.

12. A method of operating an ink jet recording apparatus, said apparatus including a recording head for discharging ink through an ink discharge port therein onto a recording medium, a cap for capping the ink discharge port, sucking means for sucking ink in the cap, and feeding means for feeding the recording medium, said method comprising the steps of:

determining if the feeding means has fed the recording medium by a predetermined amount;

moving the recording head to a position at which the recording head faces the cap so as to cause the recording head to discharge ink through the ink discharge port into the cap when the feeding means has fed the recording medium by a predetermined amount;

determining if the recording medium has been fed out from the feeding means; and sucking ink collected in the cap when the recording medium has been fed out from the feeding means, by means of the sucking means.

13. The method of claim 12, further including capping a peripheral portion of the ink discharge port of the recording head with the cap before the discharge of ink into the cap and after said moving of the recording head.

14. The method of claim 12, further including generating thermal energy used for discharging ink by a heat generating element in the recording head.

15. The method of claim 12, further including generating mechanical energy used for discharging ink by a piezoelectric element in the recording head.

16. A method of operating an ink jet recording apparatus, said apparatus including a recording head for discharging ink through an ink discharge port therein onto a recording medium, a cap for capping the ink discharge port, sucking means for sucking ink n the cap, and feeding means for feeding the recording medium, said method comprising the steps of:

determining if the feeding means has fed the recording medium by a predetermined amount;

moving the recording head to a position at which the recording head faces the cap so as to cause the recording head to discharge ink through the ink discharge port into the cap when the feeding means has fed the recording medium by a predetermined amount;

determining if the recording head is facing the cap for a time period longer than a predetermined time period; and sucking ink collected in the cap when the recording head is facing the cap for a time period longer than the predetermined time period, by means of the sucking means.

17. The method of claim 16, further including capping a peripheral portion of the ink discharge port of the recording head with the cap before the discharge of ink and after said moving of the recording head.

18. The method of claim 16, further including generating mechanical energy used for discharging the ink by an element in the recording head.

19. A method of operating an ink jet recording apparatus, said apparatus including a recording head for discharging ink through an ink discharge port therein onto a recording medium, a cap for capping the ink discharge port, and sucking means for sucking the ink the cap, said method comprising the steps of:

determining if a predetermined time period has elapsed during a non-printing operation;

causing the recording head to discharge ink through the discharge port into the cap after the predetermined time period has elapsed during a non-printing operation;

determining if the causing step has been performed a predetermined number of times; and sucking ink collected in the cap when said causing step has been performed a predetermined number of times, by means of the sucking means.

20. A method of operating an ink jet recording apparatus, said apparatus including a recording head for discharging ink through an ink discharge port therein onto a recording medium, a cap for capping the ink discharge port and collecting ink discharged therein, sucking means for sucking ink in the cap, and feeding means for feeding the recording medium, said method comprising the steps of:

determining if the recording medium has been fed out from the feeding means; and sucking ink collected in the cap when the recording medium has been fed out from the feeding means, by means of the sucking means.

21. A method of operating an ink jet recording apparatus, said apparatus including a recording head for discharging ink through an ink discharge port therein onto a recording medium, a cap for capping the ink discharge port and collecting ink discharged therein, and sucking means for sucking the ink in the cap, said method comprising the steps of:

determining if the recording head is facing the cap for a time period longer than a predetermined time period; and sucking ink collected in the cap when the recording head is facing the cap for a time period longer than the predetermined time period, by means of the sucking means.

22. A method of operating an ink jet recording apparatus, said apparatus including a recording head for discharging ink through an ink discharge port therein onto a recording medium, a cap for capping the ink discharge port and collecting ink discharged therein, sucking means for sucking ink in the cap, and feeding means for feeding the recording medium, said method comprising the steps of:

determining if the recording head is facing the cap for a time period longer than a predetermined time period; and sucking ink collected in the cap when the recording head is facing the cap for a time period longer than the predetermined time period, by means of the sucking means.

23. An ink jet recording apparatus, comprising:

recording means for discharging ink onto a recording medium, said recording means including a recording head having at least one ink discharge port for discharging the ink;

capping means for capping said ink discharge port;

sucking means in communication with said capping means for sucking ink therefrom; and control means for determining if a predetermined time period has elapsed during a non-printing operation, and if so, actuating said recording head to discharge ink through said discharge port into said capping means, for determining if ink is discharged into said capping means a predetermined number of items, and if so, actuating said sucking means to suck ink from said capping means, and for determining if the non-printing operation continues for a second period of time longer than the predetermined period of time, and if so, cutting off power to said recording means.

24. An ink jet recording apparatus, comprising:

recording means for discharging ink onto a recording medium, said recording means including a recording head having at least one ink discharge port for discharging the ink;

capping means for capping said ink discharge port;

sucking means in communication with said capping means for sucking ink therefrom;

feeding means for feeding the recording medium; and control means for determining if a predetermined time period has elapsed during a recording operation, and if so, moving said recording means to a position at which said recording head faces said capping means and actuating said recording head to discharge ink through said ink discharge port into said capping means, and for determining if the recording medium has been fed out from said feeding means, and if so, actuating said sucking means to suck ink collected in said capping means.

25. An ink jet recording apparatus, comprising:

recording means for discharging ink onto a recording medium, said recording means including a recording head having at least one ink discharge port for discharging the ink;

capping means for capping said ink discharge port;

sucking means in communication with said capping means for sucking ink therefrom; and control means for determining fi a predetermined time period has elapsed during a recording operation, and if so, moving said recording means to a position at which said recording head faces said capping means and actuating said recording head to discharge ink through said discharge port into said capping means, and for determining if said recording head is facing said capping means for a time period longer than the predetermined time period, and if so, actuating said sucking means to suck the ink collected in said capping means.

26. An ink jet recording apparatus, comprising:

recording means for discharging ink onto a recording medium, said recording means including a recording head having at least one ink discharge port for discharging the ink;

capping means for capping said ink discharge port;

sucking means in communication with said capping means for sucking ink therefrom;

feeding means for feeding the recording medium; and control means for determining if said feeding means has fed the recording medium by a predetermined amount, and if so, moving said recording means to a position at which said recording head faces said capping means and actuating said recording head to discharge ink through said ink discharge port into said capping means, and for determining if the recording medium has been fed out from said feeding means, and if so, actuating said sucking means to suck the ink collected in said capping means.

27. An ink jet recording apparatus, comprising:

recording means for discharging ink onto a recording medium, said recording means including a recording head having at least one ink discharge port for discharging the ink;

capping means for capping said ink discharge port;

sucking means in communication with said capping means for sucking ink therefrom;

feeding means for feeding the recording medium; and control means for determining if said feeding means has fed the recording medium by a predetermined amount, and if so, moving said recording means to a position at which said recording head faces said capping means and actuating said recording head to discharge ink through said ink discharge port into said capping means, and for determining if the recording head is facing said capping means for a time period longer than a predetermined time period, and if so, actuating said sucking means to suck the ink collected in said capping means.

28. An ink jet recording apparatus, comprising:

recording means for discharging ink onto a recording medium, said recording means including a recording head having at least one ink discharge port for discharging the ink;

capping means for capping said ink discharge port;

sucking means in communication with said capping means for sucking ink therefrom; and control means for determining if a predetermined time period has elapsed during a non-printing operation, and if so, actuating said recording head to discharge ink through said discharge port into said capping means, and for determining if ink is discharged into said capping means a predetermined number of items, and if so, actuating said sucking means to suck ink from said capping means.

29. An ink jet recording apparatus, comprising:

recording means for discharging ink onto a recording medium, said recording means including a recording head having at least one ink discharge port for discharging the ink;

capping means for capping said ink discharge port and collecting ink discharged therein;

sucking means in communication with said capping means for sucking ink therefrom;

feeding means for feeding the recording medium; and control means for determining if the recording medium has been fed out from said feeding means, and if so, actuating said sucking means to suck ink collected in said capping means.

30. An ink jet recording apparatus, comprising:

recording means for discharging ink onto a recording medium, said recording means including a recording head having at least one ink discharge port for discharging the ink;

capping means for capping said ink discharge port and collecting ink discharged therein;

sucking means in communication with said capping means for sucking ink therefrom; and control means for determining if the recording head is facing said capping means for a time period longer than a predetermined time period, and if so, actuating said sucking means to suck the ink collected in said capping means.

* * * * *

UNITED STATES PATENT AND TRADEMARK OFFICE

CERTIFICATE OF CORRECTION

PATENT NO. : 4,967,204

DATED : October 30, 1990

INVENTOR(S) : KOJI TERASAWA ET AL.

It is certified that error appears in the above-identified patent and that said Letters Patent is hereby corrected as shown below:

AT [57] ABSTRACT

Line 7, "numbers" should read --number--.
Line 12, "been lapsed" should read --elapsed--.

COLUMN 1

Line 26, "ports," should read --ports--.
Line 33, "printing" should read --printing,--.

COLUMN 2

Line 28, "numbers" should read --number--.
Line 33, "been lapsed" should read --elapsed--.

COLUMN 3

Line 54, "by" should be deleted.

COLUMN 6

Line 1, "perspective" should read --perspective view--.

COLUMN 7

Line 52, "operating" should read --operation--.
Line 68, "operating;" should read --operation;--.

COLUMN 9

Line 23, "n" should read --in--.

UNITED STATES PATENT AND TRADEMARK OFFICE

CERTIFICATE OF CORRECTION

PATENT NO. : 4,967,204

DATED : October 30, 1990

INVENTOR(S) : KOJI TERASAWA ET AL.

It is certified that error appears in the above-identified patent and that said Letters Patent is hereby corrected as shown below:

COLUMN 11

Line 19, "fi" should read --if--.

COLUMN 12

Line 27, "items," should read --times,--.

Signed and Sealed this

Thirty-first Day of March, 1998

Bruce Lehman

*Attest:*

BRUCE LEHMAN

*Attesting Officer*

*Commissioner of Patents and Trademarks*